United States Patent [19]

Van Kol

[11] 4,439,772

[45] Mar. 27, 1984

[54] INDUCTOR TYPE HALF WAVE ANTENNA

[76] Inventor: Gerald W. Van Kol, 10651 Santa Lucia Rd., Monta Vista, Calif. 95014

[21] Appl. No.: 264,855

[22] Filed: May 18, 1981

[51] Int. Cl.[3] ..... H01Q 9/32

[52] U.S. Cl. ..... 343/749; 343/862

[58] Field of Search ..... 343/722, 749, 895, 862

[56] References Cited

U.S. PATENT DOCUMENTS

| | | | |
|---|---|---|---|
| 2,210,491 | 8/1940 | Lewis | 343/862 |
| 2,941,207 | 6/1960 | Bunce | 343/900 |
| 3,066,294 | 11/1962 | Pan et al. | 343/844 |
| 3,259,901 | 7/1966 | Bykerk | 343/749 |
| 3,445,849 | 5/1969 | Sanford | 343/749 |
| 4,028,704 | 6/1977 | Blass | 343/715 |
| 4,238,799 | 12/1980 | Parfitt | 343/715 |

FOREIGN PATENT DOCUMENTS

| | | | |
|---|---|---|---|
| 285106 | 2/1928 | United Kingdom | 343/749 |

*Primary Examiner*—Eli Lieberman
*Attorney, Agent, or Firm*—Gerald L. Moore

[57] ABSTRACT

A half wave antenna that is physically shortened by incorporating one or more inductors which are formed by convoluting a portion of the antenna wire and wrapping the convoluted section in a spiral.

12 Claims, 9 Drawing Figures

INDUCTOR TYPE HALF WAVE ANTENNA

BACKGROUND OF THE INVENTION

This invention relates to the type of antenna comprising a length of radiating conductor which is a multiple of the half wave length for the frequency for which the antenna is designed. Such antennas offer the advantages of being omnidirectional when mounted in a vertical plane, fairly lightweight, having a relatively low wind resistance and being reasonably usable in all applications, i.e. mobile, aircraft and ships. However, such antennas are not small or compact in length and previous efforts to shorten the antennas have resulted in a substantial loss in gain.

It is the purpose of the present invention to provide a half wave length antenna that is shorter in physical length yet higher in gain than other half wave length antennas.

SUMMARY OF THE INVENTION

A physically shortened electrically half wave antenna utilizing an electrical conductor extending along a central axis and having a total length that is a multiple of the half wave length for the designed radio frequency. Intermediate the ends of the conductor is an inductor formed by convoluting a section of the conductor by the formation of alternately repeating direction changes connected by straight wire segments. This convoluted section is then wrapped in a spiral configuration extending in a plane transverse to the axis and in a manner such that no straight segments of adjacent turns lie parallel. In this manner a high inductance low capacitance antenna section is formed allowing for a higher multiple of half wave lengths to be fitted within a total physical length for the antenna while causing little or no reduction in the overall antenna gain.

DESCRIPTION OF THE INVENTION

Figure 1B:
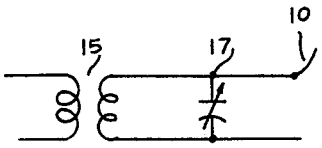
FIG. 1B is a schematic of the electrical equivalent of the intermediate transformer.
Figure 1:
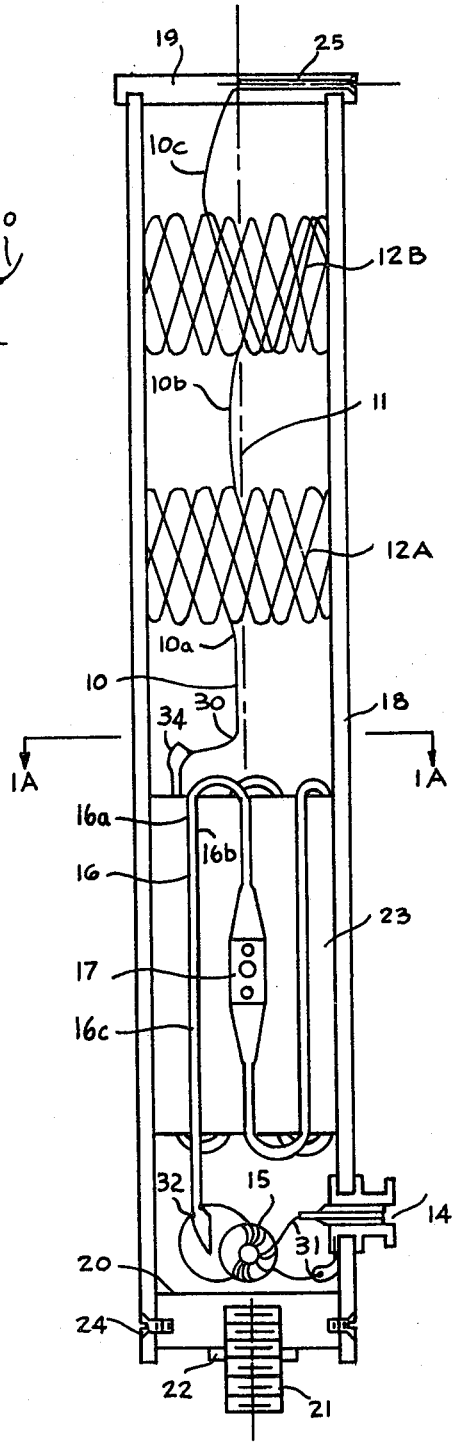
FIG. 1 is a cross-sectional view of an antenna embodying the present invention.

In FIG. 1 is shown one embodiment of the invention in which a radiating conductor 10 extends along a central axis 11 to form a half wave length antenna. The conductor serves as a radiating wire which has a total length equal to a whole number multiple of a one-half wave length for the frequency $F_1$ for which the antenna is designed. In the particular instance this antenna has an electrical length of three half wave lengths for 27 megahertz radiation. If the radiating wire were stretched out lengthwise the antenna would be 15.080 meters long, however, the actual length of the antenna package is 2.073 meters. Thus there is a length reduction of 13.007 meters or 86.25%.

The length reduction is effected by incorporating into the radiating conductor at least one eliptically convoluted inductor 12 which provides the necessary electrical radiating length while not requiring the total physical length, i.e. the wire physical length along the central axis is shortened. The manner of forming the inductors will be explained later.

In the present invention a lead-in (not shown) is connected to the BNC female connector 14 which is electrically coupled to a ferrite toroidal coil functioning as a 1;1 balun isolating transformer. This transformer and its attachment to the "L" folded two conductor dielectric ribbon, are the high Z matching structure, called "high impedance-transformer" capable of multiple wavelength operation. The secondary winding of the transformer is connected to an L folded two conductor dielectric ribbon 16 incorporating a peak balance capacitor 17. The opposite end of this ribbon is connected to the radiating conductor 10.

The antenna preferably is housed in a fiberglass tube or housing 18 having the top end closed by a phenolic waterproof cap 19. The bottom end is sealed by another phenolic plug having a threaded bolt 21 threaded into a center opening and held in place by a lock nut 22. Additionally set screws 24 are used to rigidly hold the lower plug since it serves as a mounting base. The upper end of the radiating conductor is retained by a nylon dielectric screw 25 threaded into the phenolic plug 19.

Figure 1A:
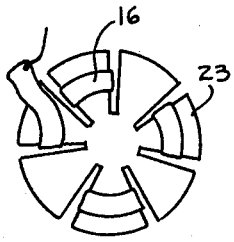
FIG. 1A is a cross-sectional view taken along the line 1A—1A of FIG. 1.

The dielectric ribbon 16 and the balun transformer 15 function to isolate the radiating conductor 10 from the source in the manner of an intermediate transformer. In a preferable embodiment the balun transformer couples the 50 ohm impedance connector 14 to the 1200 or 2400 ohm impedance radiating conductor. The impedance of the radiating conductor is one of choice of the designer. The dielectric ribbon includes two conductors **16*a* and 16*b* separated by a dielectric insulator 16*c* and is supported in a poly-foam core 23 (see FIG. 1A) having slots 23A formed therein into which the ribbon is wedged. This structure electrically isolates the ribbon from the fiberglass tube. The poly-foam core has a dielectric strength of approximately 1.05 in the X band range while the fiberglass tube has a dielectric strength in the range of 5 to 7. Thus, the isolation of the ribbon from the fiberglass tube prevents detuning of the transformer as would happen with contact with the tube. By this intermediate transformer structure there is provided a structurally smaller intermediate transformer functioning similar to a dipole end fire type. As shown in FIG. 1B the ferrite core balun transformer 15** isolates the intermediate transformer while the variable capacitance allows for compensation for impedance and the voltage standing wave ratio (VSWR).

Figure 3:
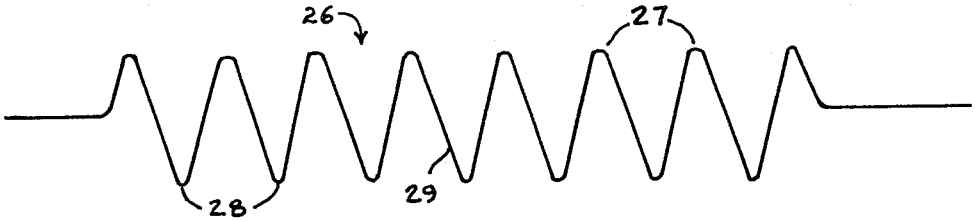
FIGS. 3 and 4 show the manner of forming the inductor.
Figure 4:
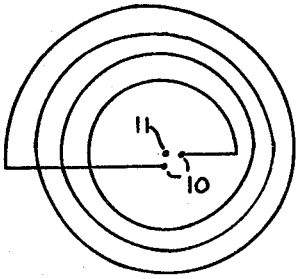

The antenna is also physically shortened by use of the eliptically convoluted inductors 12 of which two are formed by a special configuration of the radiating wire. As shown in FIG. 3, a section 26 of the wire is first formed into a convoluted configuration by the formation of a plurality of alternately repeating direction changes 27 and 28. The total number of turns formed in the radiating wire determines the overall size of the inductor. Thereafter the convoluted wire is wound in a spiral configuration in the manner shown in FIG. 4. The spiral configuration appears as shown in a side view in FIG. 1 wherein the turns 27 which are adjacent all align with a radius and the turns 28 which are adjacent all align with a radius. In this manner the straight wire segments 29 which join the alternate wire direction changes always extend substantially normal to each other between adjacent layers. This means that there is a minimum of capacitance between these layers thereby rendering the convoluted eliptical coil substantially inductive. The electrical resistance for the radiating wire remains substantially the same since the overall length of the wire is the same.

It is thought the eliptically convoluted inductors are effective in improving the radiating efficiency of the antenna because the inductors exhibit very high inductance to capacitance properties. Because the adjacent coils of the inductor have only one crossover point with the adjacent coil, capacitance results mainly from the conductor length equal to the wire diameter. This length is very small in comparison to the wire length between crossover points.

Additionally because of the conformation of the conductors in the inductors, there results an increase in the magnetic field coupling as well as the electrical field coupling. This increased coupling increases the capability of the antenna to receive signals in the horizontal or magnetic polarization plane better than the standard vertically extending antenna.

Figure 2:
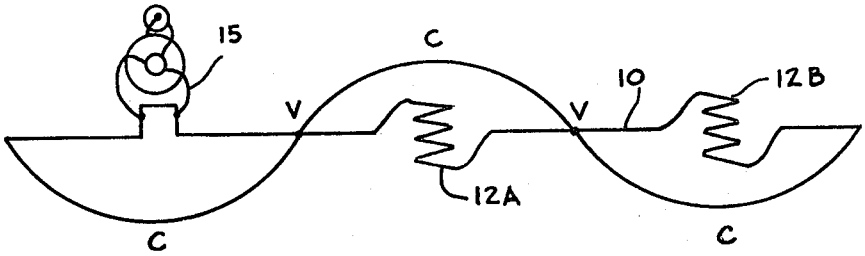
FIG. 2 is a diagrammatic sketch of the antenna showing the electrical properties of the invention.
Figure 7:
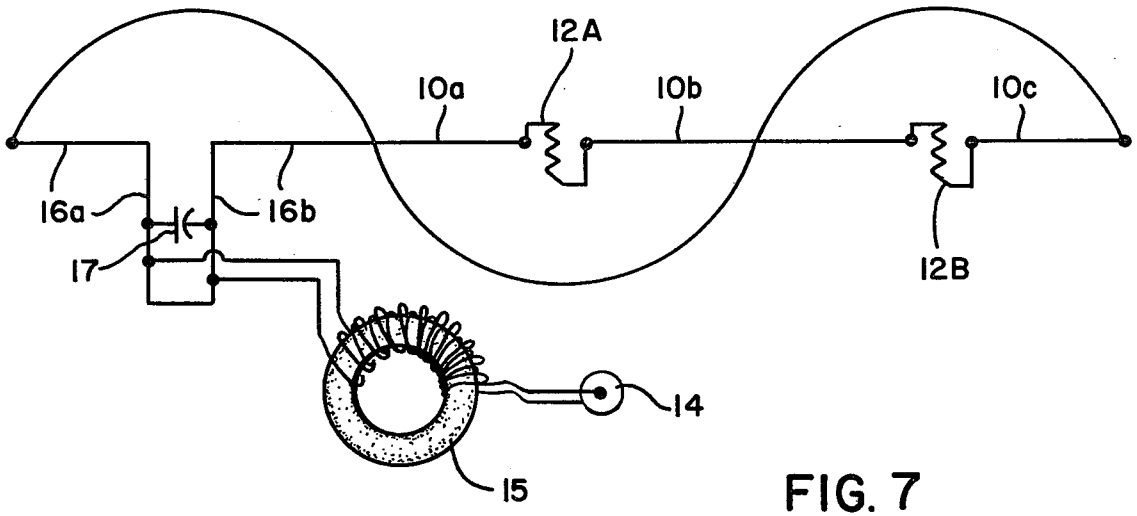
FIG. 7 is a schematic of the electrical equivalent of the antenna.

In FIG. 2 is shown diagrammatically the antenna shown in FIG. 1. The conductor wire 10 extends one-quarter wavelength in one direction from the ferrite toroid transformer 15 and one-half wavelength section 10*a* to the first eliptically convoluted inductor 12A and another half wavelength section 10*b* to the second inductor 12B and thereafter terminates after extending another one-quarter wavelength section 10*c* as shown in FIG. 7. The high impedance transformer 15 matches the half waves which are positioned between 1200 and 2400 ohms impedance. The transformer is a folded dielectric-filled half wavelength with an input near the center at an impedance point of approximately 50 ohms. A ferrite balun transformer is used to isolate the hot transformer and antenna from the low impedance coaxial feed point.

Figure 5:
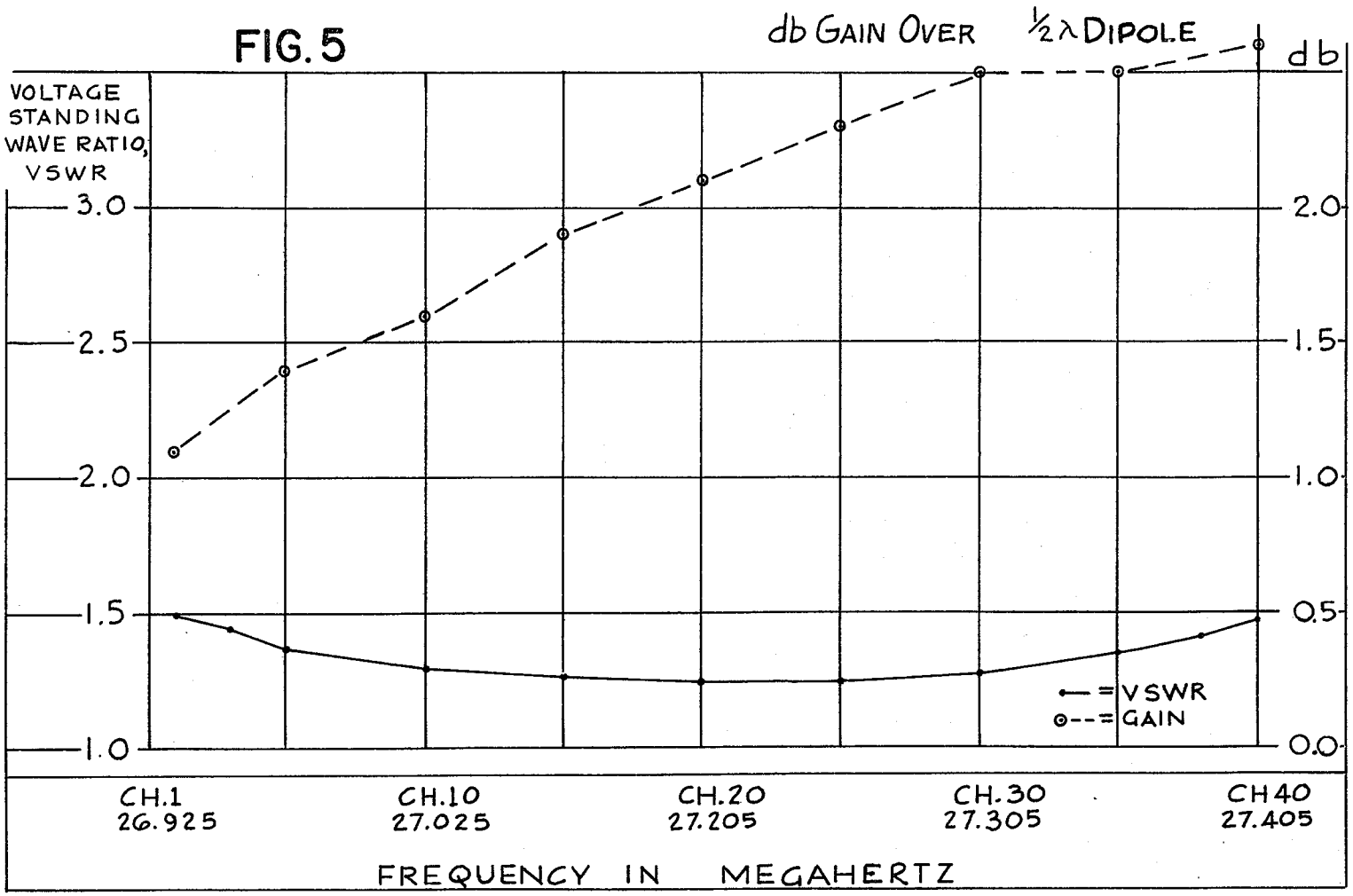
FIGS. 5 and 6 are graphs showing a comparison of the gain achieved for various lengths of antenna.

By incorporating the inductors formed as described by convoluting then spiraling the conductor wire, the physical length of the antenna can be substantially reduced for any given physical length of radiating conductor. As shown in FIG. 5 representing actual gain measured for various frequencies using an antenna made in accordance with the present invention and a standard one-half wavelength reference dipole. The radiation levels are noted on the right abscissa and the db gain is noted on the left abscissa. Frequency is the ordinate of the graph. It is easily noted that the 1.5 wavelength convoluted spiral inductor antenna is between 1.0 and 2.5 db more efficient than the reference half wave dipole antenna.

Figure 6:
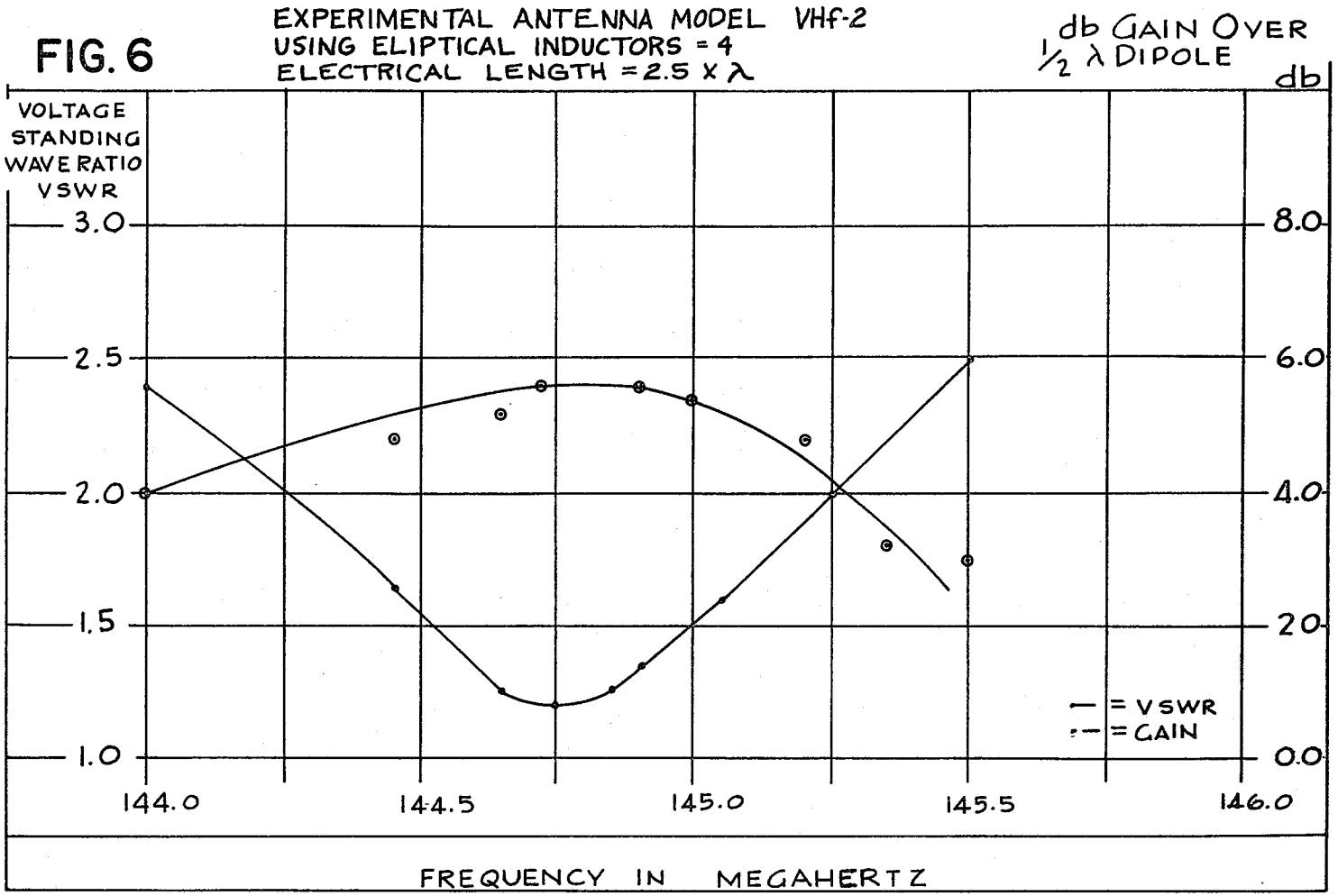

In FIG. 6 is a graph similar to that of FIG. 5 except for a 2.5 wavelength convoluted spiral inductor antenna. In the frequency range between 144.5 and 145 megahertz the inductor antenna is 2 to 3 db higher in radiation.

The invention claimed:

1. A physically shortened electrically half-wave antenna for a communication frequency $F_1$ comprising:

an electrical conductor extending along an axis and having first and second ends and a total length equal to a multiple of the half-wave length for the frequency $F_1$;

connector means connecting with the first end of said conductor; and an inductor formed intermediate the ends of said conductor wherein a section of said conductor is convoluted to include a plurality of alternately repeating direction changes connected by substantially straight conductor segments and the convoluted conductor section is wrapped in a spiral configuration in a plane extending transverse to the axis such that substantially no straight segments of adjacent turns of said section lie parallel.

2. A half-wave antenna as defined in claim 1 wherein the inductor is formed with all adjacent conductor direction changes aligned.

3. A half-wave antenna as defined in claim 2 wherein the straight conductor segments of every other turn are positioned parallel.

4. A half-wave antenna as defined in claim 1 wherein the number of direction reverses for the conductor in each turn of the spiral is an odd number.

5. A half-wave antenna as defined in claim 1 wherein a plurality of inductors are formed intermediate the ends of said conductor.

6. A physically shortened antenna for a communication frequency $F_1$, comprising:

an electrical conductor extending along an axis and having first and second ends and a total length equal to a multiple of the half-wave length for the frequency $F_1$;

an intermediate transformer connected to the first end of said conductor having first and second terminals;

a connector connecting with the first terminal of said intermediate transformer;

said intermediate transformer comprising:

an isolating transformer having first and second connections and connecting with said connector at said first connection;

a dielectric ribbon having one end connecting with said isolating transformer second connection;

a core member made of a low dielectric material and about which said ribbon is wrapped; and means connecting said dielectric ribbon second end to said electrical conductor.

7. An antenna as defined in claim 6 wherein said core member includes slots formed in the periphery and extending in the direction of the axis of said electrical conductor with said dielectric ribbon being wrapped in said slots.

8. An antenna as defined in claim 7 including a fiberglass housing enclosing the antenna.

9. An antenna comprising:

an electrical conductor extending in the general direction of a center axis;

an intermediate transformer connected to one end of said electrical conductor, said intermediate transformer comprising:

a dielectric ribbon including two conductors;

means connecting one conductor to said one end of said electrical conductor;

an isolating transformer having a secondary and primary coil with said secondary coil connected to the other end of said dielectric ribbon;

a connector connected to said primary coil of said isolating transformer; and a low dielectric core member supporting said dielectric ribbon with the ribbon being wrapped therearound.

10. An antenna as defined in claim 9 wherein said core member includes a plurality of slots therein extending along the axis of said electrical conductor; and said dielectric ribbon is wrapped to extend along said slots.

11. An antenna as defined in claim 9 wherein said conductor includes an inductor formed intermediate the ends thereof formed by convoluting a section of said conductor to include a plurality of alternately repeating direction changes connected by substantially straight conductor segments and wrapping the convoluted conductor in a spiral configuration.

12. An antenna as defined in claim 9 including a capacitor connecting the two conductors of said dielectric ribbon intermediate the ends thereof.

* * * * *